United States Patent [19]

Betcher

[11] 4,340,809

[45] Jul. 20, 1982

[54] SECURITY DEVICE AND METHOD FOR POSTAGE METER MACHINES

[76] Inventor: Robert H. Betcher, 4751 NW. 17th Ave., Miami, Fla. 33142

[21] Appl. No.: 218,733

[22] Filed: Dec. 22, 1980

[51] Int. Cl.[3] ..... G07G 1/00

[52] U.S. Cl. ..... 235/101; 235/130 R

[58] Field of Search ..... 235/101, 130 R, 130 KD, 235/130 TC; 101/19

[56] References Cited

U.S. PATENT DOCUMENTS

| | | | |
|---|---|---|---|
| 2,522,237 | 9/1950 | Ryan et al. | 235/101 |
| 3,502,266 | 3/1970 | Clemons | 235/101 |
| 4,099,049 | 7/1978 | Lowe | 235/101 |

*Primary Examiner*—L. T. Hix
*Assistant Examiner*—Benjamin R. Fuller
*Attorney, Agent, or Firm*—Malin & Haley

[57] ABSTRACT

The present disclosure has to do with the prevention of the fraudulent alteration of postage meter tapes whereby they can be used without paying the proper postage. A simple locking device may be added to existing postage meters whereby the postage meter cannot be operated unless the actual meter is in place. Therefore if the meter is removed the postage meter will not be operational until the machine is replaced. Mechanical or electronic counters can also be installed to record the removal activity and if it is exceptionally high could be questioned by proper authorities.

4 Claims, 8 Drawing Figures

SECURITY DEVICE AND METHOD FOR POSTAGE METER MACHINES

BACKGROUND OF THE INVENTION

Presently a problem exists in certain postage machines in that it is quite easy to counterfeit postage tapes without actually recording the amount on the postage meter itself. In order to accomplish this all that is needed is a plurality of rubber stamps made in the denominations that are needed, printing the postage tapes with zero postage on the meter and then rubber stamping the correct denominations on the postage tapes for the particular class of mail, zone and weight. In order that the zero amount is not actually printed on the postage tape the actual meter must be removed so that the postage tape is exposed. The postage tape guide can then be marked with any device such as a pencil and then the tape may be studied to determine where the zeroes of the meter are printed in relation to the pencil mark. Once the position where the zero will print out is determined, any material such as a pressure sensitive label can be used to cover the area of the postage tape to be printed with a zero and actually take the zero printing there on. The pressure sensitive label is then removed from the postage tape leaving a blank space thereupon for the price of the postage. The desired amount of postage can then simply be placed in the unmarked area with a rubber stamp. Postage meter tapes can be used for letters or parcels.

The present invention provides a security device and method for overcoming this problem which prevents the postage meter from being removed from the postage machine whenever the postage tape is exposed in the stamping aperture of the machine, locks the postage machine in a postage tape concealed position whenever the postage meter is removed from the machine and prevents operation of the machine with the postage meter removed from the machine. A mechanical or electronic counter to count the number of times the machine has been placed in the "meter remove" position or the meter has actually been removed could also be used to monitor removal activity.

In the past, there have been various methods used to provide for security of checks, labels and general documents, however there appear to be none that address the problem of the fraudulent use of postage meter machines. Patents of interest are as follows: U.S. Pat. No. 4,121,961; U.S. Pat. No. 3,858,705; U.S. Pat. No. 3,565,463; and U.S. Pat. No. 2,604,710.

SUMMARY OF THE INVENTION

According to the present invention a postage meter machine security device and method is presented. The system comprises an inter-locking system such that when the mechanical levers associated with operating the postage meter machine are set in certain positions, or the actual postage meter is removed, the postage meter machine will not operate until the postage meter is replaced.

The security device may also include either a mechanical or electronic counter which can be installed to indicate the number of times the control levers of the machine are moved to a position which allows removal of the meter or the number of times the meter is actually removed. These counters can be monitored on a periodic basis by the proper selected authorities and any exceptionally high activity of meter removal would indicate probable tampering of the machine.

It is therefore an object of this invention to provide a security method which prevents the fraudulent use of postage meter machines.

It is another object of this invention to provide an interlocking device for existing postage meter machines which will prevent the exposure of the postage tape with the postage meter removed.

It is yet another object of this invention to provide an interlocking device for existing postage meter machines which will prevent operation of the machine with the postage meter removed.

It is another object of this invention to provide a security system for a postage meter machine which records the number of times the postage meter is removed.

In accordance with these and other objects which will be apparent hereinafter, the instant invention will now be described with particular reference to the accompanying drawings.

DESCRIPTION OF THE PREFERRED EMBODIMENT

Figure 1:
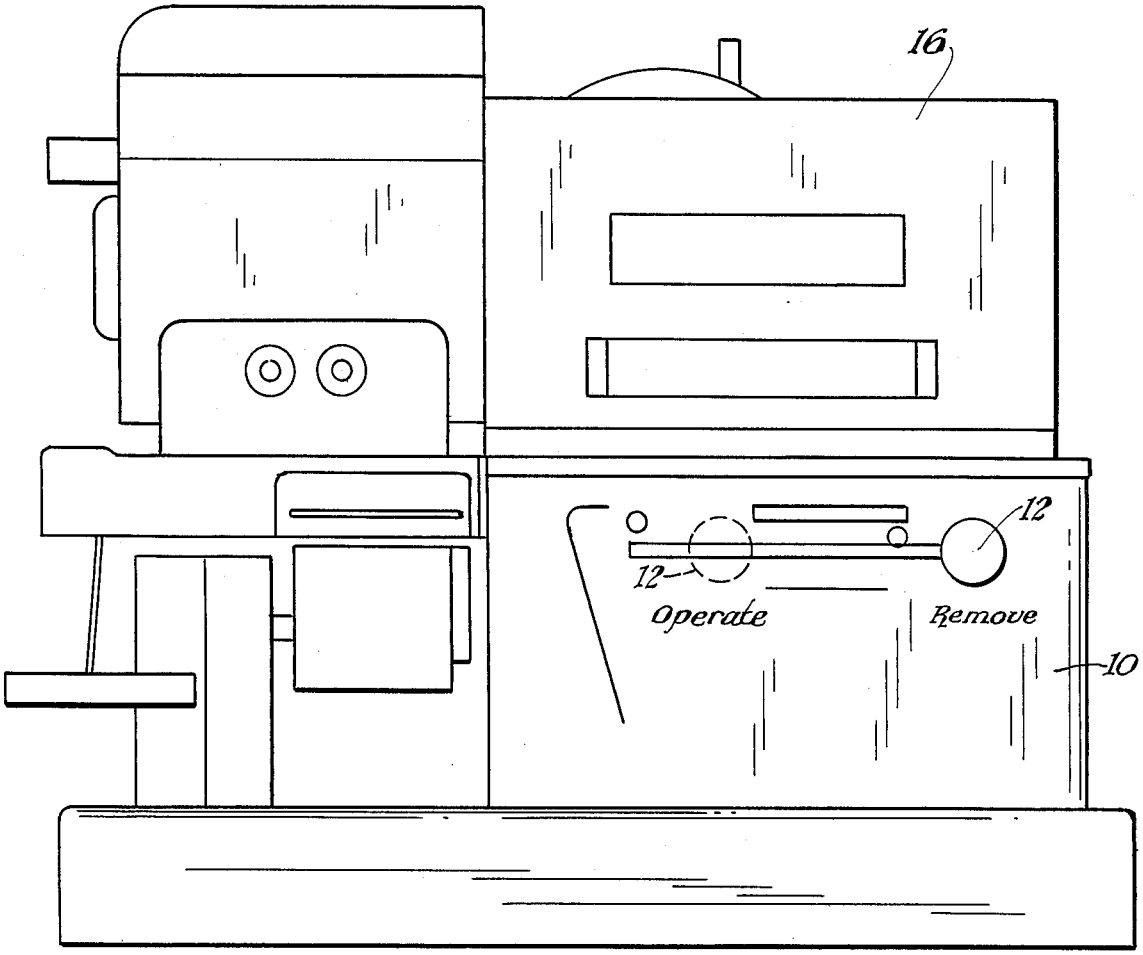
FIG. 1 is a right side view of a postage meter machine.
Figure 4B:
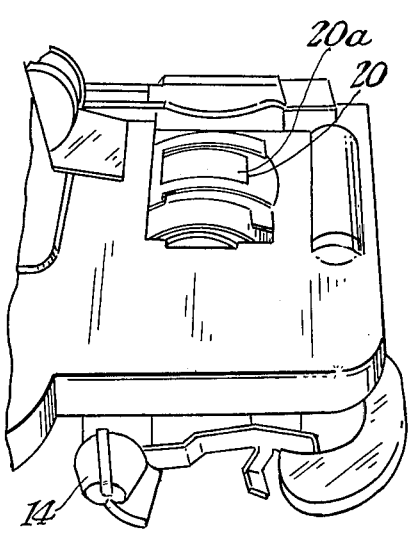
FIG. 4B is a partial top view of the postage meter machine in the "tape" position with the postage meter removed (paper tape is exposed).
Figure 2:
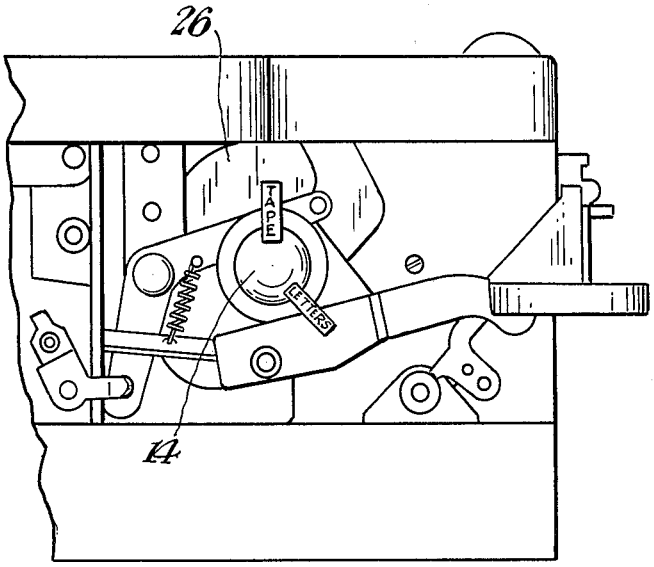
FIG. 2 is a partial front view of a postage meter machine.

Referring now to the drawings and more particularly to FIGS. 1 through 4, a postage meter machine such as a Pitney-Bowes Model 4200 is shown generally at 10 (FIG. 1). However, the invention can be used on other similar makes and models. The key elements which enable tampering of the postage machine are the operate-remove lever 12 shown in FIG. 1, and the letter-tape control 14 (FIG. 2) which is shown on the front of the machine. In order to remove the postage meter 16 (FIG. 1) from the machine 10, the lever 12 must be placed in the remove position (rearward). Once the meter 16 (FIG. 1) is removed the stamping aperture 20 (FIG. 4B) of the machine is easily accessible for manual tampering. Thus, with the postage meter removed and the letter-tape control 14 placed in the tape position (FIG. 4B and FIG. 2) the tape **20*a* is moved into the plane of the stamping aperture (FIG. 4B**) and is exposed for easy stamping of =00 on pressure sensitive labels placed on the meter tape as explained in the Background of the Invention.

Therefore a device is needed which will lock the letter-tape knob 14 (FIG. 2) in the "letter" position and the operate-remove arm 12 (FIG. 1) in the "remove" position whenever the meter 16 is removed and also to prevent removal of the postage meter 16 when the letter tape knob 14 is in the tape position.

The postage meter machine 10 also includes a plate 22 (FIG. 3) which can be removed for servicing the machine.

Also, located behind the letter-tape knob 14 is a circular disc 26 (See FIGS. 5 and 6) which has an open portion 28. The disc 26 rotates with the letter-tape control knob as does the open portion of the disc.

Figure 7:
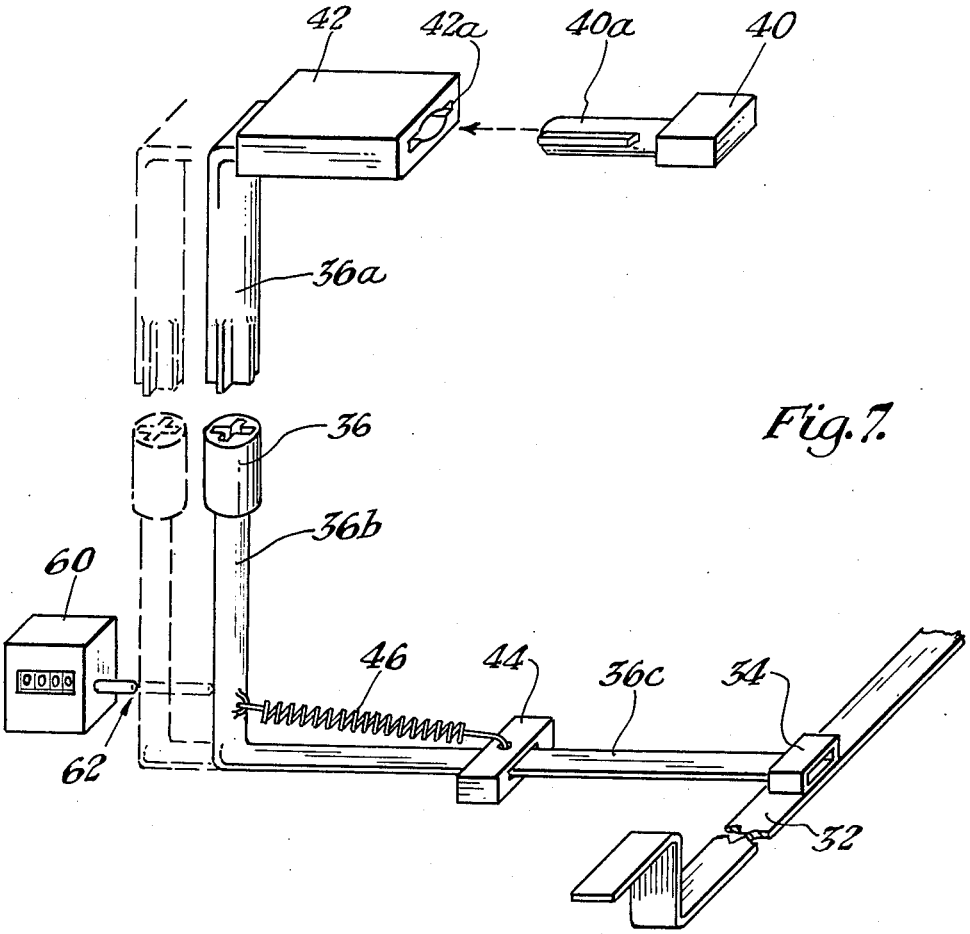
FIG. 7 is a perspective view of a safety lock portion of the invention which actuates when the postage meter is removed.
Figure 3:
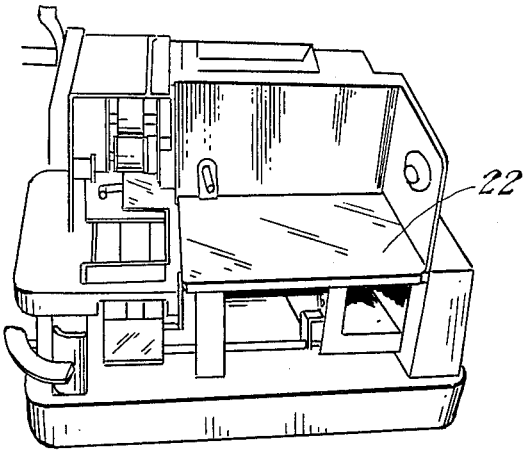
FIG. 3 is a partial right side view of the postage meter machine with the postage meter removed.
Figure 4A:
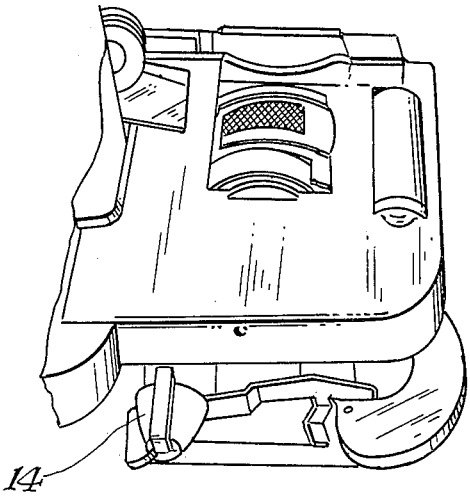
FIG. 4A is a partial top view of the postage machine in the "letter" position with the postage meter removed (paper tape is concealed).
Figure 5:
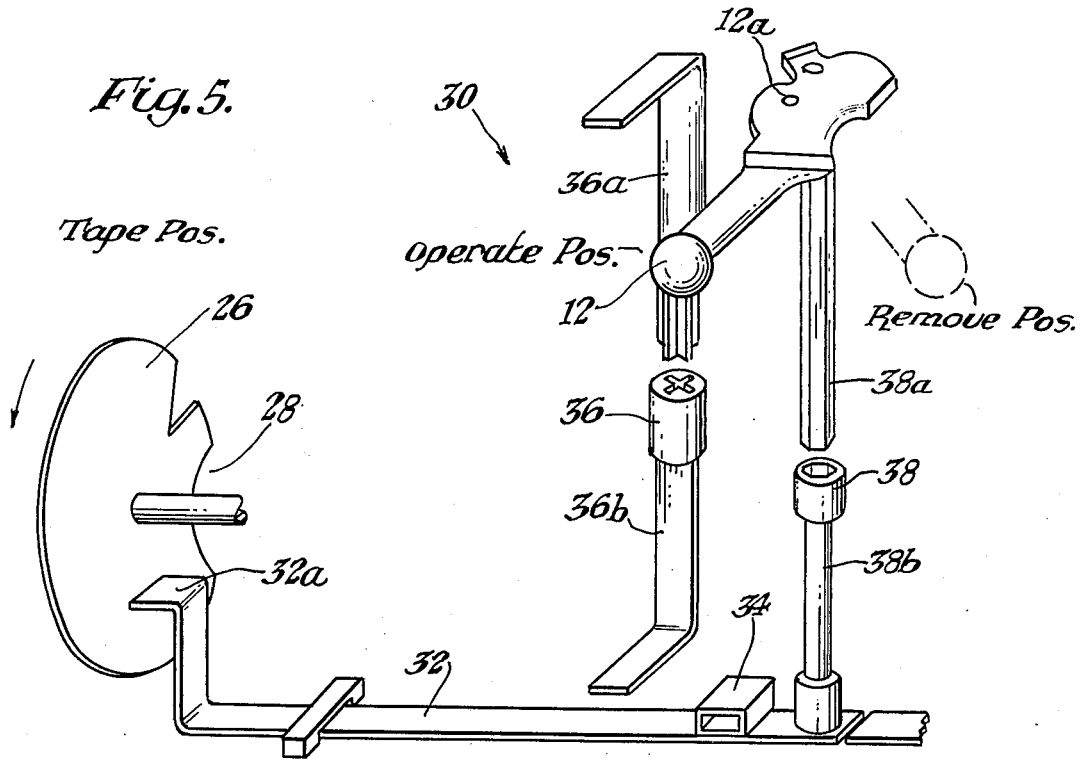
FIG. 5 is a perspective view of the present invention in a position to prevent removal of the postage meter from the postage machine.
Figure 6:
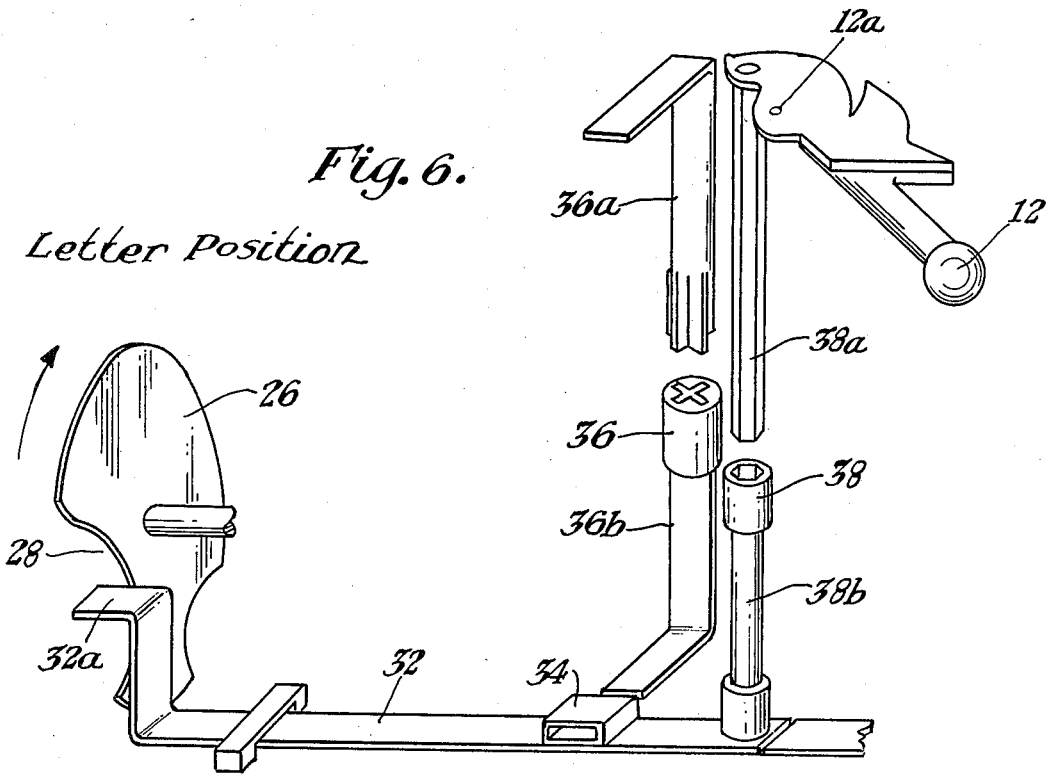
FIG. 6 is a perspective view of the present invention in a position to prevent the operation of the postage machine with the postage meter removed.

Referring now to FIGS. 5, 6, and 7 the present invention is shown generally at 30 and comprises a first control arm 32 having a locking sleeve 34 which cooperates with the locking arm 36. A second control arm 38 is connected to the rear end of the first contrl arm 32 such that its top end cooperates with the operate-remove control lever 12 of the postage machine behind the rotational axis 12*a* of the control arm 12.

Since the top portion 38*a* of control arm 38 is connected behind the axis of rotation 12*a* of the operate-remove lever 12, whenever the letter-tape control 14 is in the tape position (i.e. fully clockwise) the open portion 28 of the disc 26 is not in alignment with the front end 32*a* of the first control arm 32 and the first control arm 32 is in close relation to the disc. Thus, with the letter-tape control 14 in the tape position, the operate-remove lever 12 cannot be placed in the "remove" position since the front end 32*a* of the first control arm 32 is already in contact with the disc. This restricts forward longitudinal movement of the arm 32 and arm 38, preventing the operate-remove lever from being placed in the "remove" position.

However, when the letter-tape control 14 is placed in the "letter" position (FIG. 4A), concealing the tape 20*a* out of the area of the stamping aperture 20 of the postage machine, the open portion 28 of the disc is in alignment with the first locking arm 32 allowing forward longitudinal movement of the arm 32 and 38 so that the operate-remove lever 12 can be placed in the "remove" position.

With the meter removed, it is necessary to prevent movement of the operate-remove lever 12 back into the operate position, which would also enable manual tampering of the machine. Therefore, the operate-remove lever 12 must also be locked in the remove position whenever the meter 16 is removed. Referring now to FIG. 7, the bottom (not shown) of the postage meter 16 will have a key member 40 fixed thereto with a keyed connector 40*a* designed to fit in the key guideway 42*a* of the sleeve 42 which is fixed to the service plate 22 (FIG. 3) and actuates locking arm 36 (FIG. 7). The keyed connector 40*a* allows the locking member 36*c* which is biased toward the arm 32 by the spring 46 to move transversely into the sleeve 34 of first control arm 32 whenever the meter is removed. The keyed connector 40*a* forces the locking member 36*c* out of the locking sleeve 34 whenever the postage meter 16 is replaced. Therefore with the meter 16 removed, the operate-remove lever 12 cannot be placed into the operate mode and the letter-tape control 14 cannot be placed in the tape position.

The second control arm 38 and the locking arm 36 have respective upper segments 38*a* and 36*a* which have their top ends fixed to the service plate 22 and their lower ends keyed to mate with the top ends of the respective lower segments 38*b* and 36*b*. Thus if the upper segments are removed from the service plate 22, or the service plate is left off, the "operate-remove" lever 12 will remain locked.

A simple counter 60 with plunger 62 advance could also be operably connected to the locking arm 36 to count the number of times the meter has been removed as shown in FIG. 7. An electrically activated counter could also be used.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A security device for a postage meter machine having a rotatable control knob including a letter position and a tape position and a control lever having a machine operate position and meter remove position, comprising:

a disc having an open portion and connected to said rotatable control knob;

a first control arm having a first end for communicating with said disc and a locking sleeve, said first control arm slidably connected to said machine to slide in a plane perpendicular to the plane of said disc;

a second control arm having its upper end in communicating relation with said control lever and its lower end connected to said first control arm;

a locking arm having an upper end for communication with said postage meter and a lower end, said locking arm slidably connected to said machine to slide in a direction perpendicular to the movement of said first control arm;

biasing means for biasing said locking arm towards said first control arm, operably connected to said locking arm and said machine;

said control lever moving said first control arm and said second control arm towards said disc when changed from the machine operate position to said meter remove position;

said first end in communication with said disc when said rotatable control knob is in the tape position, preventing movement of said first and second control arms, locking said control lever in the machine operate position;

said first end in alignment with said open portion when said rotatable control knob is in the letter position, allowing movement of said first and second control arms, enabling said control lever to be moved into said meter remove position and locking said rotatable control knob in the letter position;

said lower end of said locking arm engaging with said locking sleeve when said meter is removed and disengaging said locking sleeve when said meter is replaced.

2. A security device as set forth in claim 1, wherein:

said machine having a service plate;

said locking arm and said second control arm each having a keyed upper segment and a lower segment for receiving said upper segment, each said upper segment connected to said service plate such that when said service plate is removed, said control lever remains locked in the remove position.

3. A security device as set forth in claim 1, wherein:

said biasing means is a spring.

4. A method for preventing the tampering of a postage meter machine having a first control for a meter remove position and a machine operate position, and a second control for a postage tape exposed position and a postage tape concealed position, comprising the steps of:

providing means for communication between said first control and said second control;

locking said first control in the machine operate position when said second control is in the postage tape exposed position;

locking said second control in the postage tape concealed position when said first control is in the meter remove position;

locking said first control in the meter remove position when said meter is removed.

* * * * *